US010106358B2

(12) United States Patent
Weng et al.

(10) Patent No.: US 10,106,358 B2
(45) Date of Patent: Oct. 23, 2018

(54) PAPER MONEY STACKING APPARATUS AND PAPER MONEY PROCESSING DEVICE

(71) Applicant: GRG Banking Equipment Co., Ltd., Guangzhou, Guangdong (CN)

(72) Inventors: Qiuhua Weng, Guangdong (CN); Dong Tan, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/560,448

(22) PCT Filed: Sep. 29, 2015

(86) PCT No.: PCT/CN2015/091036
§ 371 (c)(1),
(2) Date: Sep. 21, 2017

(87) PCT Pub. No.: WO2016/150138
PCT Pub. Date: Sep. 29, 2016

(65) Prior Publication Data

US 2018/0072530 A1 Mar. 15, 2018

(30) Foreign Application Priority Data

Mar. 26, 2015 (CN) ..... 2015 1 0135943

(51) Int. Cl.
*B07C 5/00* (2006.01)
*B65H 31/10* (2006.01)
(Continued)

(52) U.S. Cl.
CPC ..... *B65H 31/10* (2013.01); *B65H 31/3027* (2013.01); *B65H 31/36* (2013.01);
(Continued)

(58) Field of Classification Search
CPC .... B65H 2701/1912; B65H 2404/2211; B65H 2404/2693; B65H 31/10; B65H 31/3027; B65H 31/36; G07D 2211/00
(Continued)

(56) References Cited

U.S. PATENT DOCUMENTS 3,881,722 A 5/1975 Pruess
5,897,114 A 4/1999 Arikawa et al.
(Continued)

FOREIGN PATENT DOCUMENTS

CN 101266703 A 9/2008
CN 102819892 A 12/2012
(Continued)

OTHER PUBLICATIONS

International Search Report for Application No. PCT/CN2015/091036 dated Jan. 13, 2016.
(Continued)

*Primary Examiner* — Terrell H Matthews
(74) *Attorney, Agent, or Firm* — Wolf, Greenfield & Sacks, P.C.

(57) ABSTRACT

A banknote stacking device includes an input mechanism configured to convey banknotes one by one, a stacking platform mechanism configured to stack and support banknotes conveyed by the input mechanism one by one a pressing and conveying mechanism located above the stacking platform mechanism and configured to press banknotes and convey the banknotes stacked on the platform forward. The pressing and conveying mechanism has a pressing rod, and the pressing rod has one end rotatably arranged on the upper conveying rotating shaft and another end forming a free end and falling freely towards the platform, the rotatable securing end and the free end of the pressing rod are respectively provided with a first concave wheel and a
(Continued)

second concave wheel, and a first O-shaped belt is arranged on the first concave wheel and the second concave wheel. The first concave wheel rotates synchronously with the upper conveying rotating shaft.

13 Claims, 5 Drawing Sheets

(51) Int. Cl.
*B65H 31/30* (2006.01)
*B65H 31/36* (2006.01)

(52) U.S. Cl.
CPC ..... *B65H 2404/2211* (2013.01); *B65H 2404/2693* (2013.01); *B65H 2701/1912* (2013.01)

(58) Field of Classification Search
USPC ..... 209/509, 534
See application file for complete search history.

(56) References Cited

U.S. PATENT DOCUMENTS

| | | | | |
|---|---|---|---|---|
| 2004/0007624 | A1 | 1/2004 | Ogawa et al. | |
| 2010/0096801 | A1 | 4/2010 | Yanagida | |
| 2012/0306144 | A1 | 12/2012 | Taki et al. | |
| 2014/0061993 | A1 | 3/2014 | Shimura et al. | |
| 2014/0175733 | A1* | 6/2014 | Huang | G07D 11/0021 271/18 |
| 2014/0238251 | A1* | 8/2014 | Zhang | B65H 31/3045 100/7 |
| 2015/0175375 | A1 | 6/2015 | Jiang et al. | |
| 2015/0203318 | A1* | 7/2015 | Deng | B65H 31/38 271/83 |
| 2015/0284208 | A1* | 10/2015 | Wu | G07D 11/0018 271/306 |
| 2015/0298930 | A1* | 10/2015 | Huang | G07D 11/0018 271/199 |
| 2016/0145066 | A1* | 5/2016 | Jin | G07D 11/0018 271/199 |
| 2016/0236901 | A1* | 8/2016 | Moriwaki | G07D 11/0081 |

FOREIGN PATENT DOCUMENTS

| | | | |
|---|---|---|---|
| CN | 203246944 | U | 10/2013 |
| CN | 104355191 | A | 2/2015 |
| CN | 104670965 | A | 6/2015 |
| EP | 0 793 197 | A2 | 9/1997 |
| GB | 2487726 | A | 8/2012 |
| JP | H1171055 | A | 3/1999 |
| JP | 2003165670 | A | 6/2003 |
| JP | 2009126626 | A | 6/2009 |

OTHER PUBLICATIONS

Written Opinion of the International Searching Authority for Application No. PCT/CN2015/091036 dated Jan. 13, 2016.
Extended Search Report dated May 18, 2018 in connection with European Application No. 15886060.1.

* cited by examiner

PAPER MONEY STACKING APPARATUS AND PAPER MONEY PROCESSING DEVICE

This application is the National Phase of PCT Application No. PCT/CN2015/091036, filed Sep. 29, 2015, which claims priority to Chinese patent application No. 201510135943.X titled "BANKNOTE STACKING DEVICE AND BANKNOTE PROCESSING APPARATUS", filed with the Chinese State Intellectual Property Office on Mar. 26, 2015, the entire disclosures of both applications are incorporated herein by reference.

FIELD

The present application relates to sheet-type medium processing technology, and particularly to a banknote-type medium stacking device and a banknote processing apparatus having the stacking device.

BACKGROUND

With the continuous development of the economy, the amount of processing banknote is increasing, and the requirement for processing capacity of banknote processing apparatuses is also raised accordingly. Currently used banknote processing apparatuses generally can be divided into cash dispensers, cash deposit machines, cash recycle systems, currency sorters and the like by main functions. The main functions of these banknote processing apparatuses include basic self-service financial business such as banknote withdrawing, banknote depositing, and transfer accounts etc.

In a banknote processing apparatus, banknotes are generally stacked for being stored, thus, when processing a stack of banknotes, the stack of banknotes are required to be separated one by one by a conveying mechanism, and then are conveyed into a banknote identifier. After being identified by the banknote identifier, the separated banknotes are generally conveyed into a banknote stacking mechanism to be stacked again. Finally, the stacked banknotes are conveyed by the conveying mechanism to a next process, such as a process of outputting the stacked banknotes to a customer, a process of finishing the banknote withdrawing flow, etc. For making the whole stack of banknotes arranged tidily in the conveying process, and not causing technical issues such as misaligning and collapsing due to crossing of banknotes and further causing banknote conveying failure, the optimization of the banknote stacking device is an important subject in developing and designing a banknote processing apparatus. In currently used banknote stacking devices, banknotes are separated one by one by an impeller, and are stacked on a clamping mechanism similar to a manipulator, and the whole stack of banknotes are clamped and outputted by the manipulator. Besides a complex mechanical clamping mechanism and an impeller device, the above conveying mechanism also requires auxiliary mechanisms to cooperate with them to work, resulting in a complex whole mechanism, and with ever increasing number of banknotes processed by a banknote processing apparatus at one time, the volume of the stacking mechanism also gets larger and larger correspondingly, and cost is increased. Further, the technical issues, such as normal processing of the apparatus being affected due to deformation of banknotes, is apt to occur during the banknote conveying.

Accordingly, how to address the technical issue in the conventional technology that the conventional banknote stacking device has a complex structure, cannot stack a large number of banknotes tidily, has become a technical issue to be presently addressed by the person skilled in the art.

SUMMARY

For addressing the technical issue that a conventional banknote stacking device has a complex mechanism and an insufficient reliability, a banknote stacking device is proposed according to the present application which has a simple structure, can stack a large number of banknotes and can stack reliably, and a banknote processing apparatus employing the stacking device is further proposed according to the present application.

The banknote stacking device according to the present application includes:

an input mechanism configured to convey banknotes one by one, which includes an upper conveying belt, a lower conveying belt, an upper conveying rotating shaft configured to drive the upper conveying belt, and a lower conveying rotating shaft configured to drive the lower conveying belt;

a stacking platform mechanism configured to stack and support banknotes conveyed by the input mechanism one by one, which includes a platform configured to carry banknotes, wherein the platform and two baffles arranged front and rear in a banknote conveying direction define a space for stacking and storing banknotes, and the platform is controlled by a lifting mechanism to selectively move up and down, and the platform is preferably driven by rotation of a step motor to achieve selective lifting and descending;

a pressing and conveying mechanism located above the stacking platform mechanism and configured to press banknotes and convey the banknotes stacked on the platform forward, wherein the pressing and conveying mechanism has a pressing rod, and the pressing rod has one end rotatably arranged on the upper conveying rotating shaft and another end forming a free end and falling freely towards the platform. The rotatable securing end and the free end of the pressing rod are respectively provided with a first concave wheel and a second concave wheel, and a first O-shaped belt is arranged on the first concave wheel and the second concave wheel, and the first concave wheel rotates synchronously with the upper conveying rotating shaft, the banknotes conveyed by the input mechanism one by one are conveyed into the stacking platform mechanism, and while the pressing and conveying mechanism presses the banknotes onto the stacking platform mechanism, the concave wheels and the O-shaped belts thereon of the pressing and conveying mechanism are synchronously driven forward, and the friction force between the O-shaped belts and the banknotes drives the banknotes to move forward to a position of the front baffle, which allows front ends of the banknotes to be aligned with the front baffle.

Preferably, the first concave wheel and a third concave wheel are respectively arranged on two sides of the rotatable coupled end of the pressing rod, and the second concave wheel and a fourth concave wheel are respectively arranged on two sides of the free end of the pressing rod. The first O-shaped belt is arranged on the first concave wheel and the second concave wheel to form a first driving belt-wheel set, and a second O-shaped belt is arranged on the third concave wheel and the fourth concave wheel to form a second driving belt-wheel set. The first concave wheel and the third concave wheel rotate synchronously with the upper conveying rotating shaft.

Preferably, a belt conveying part is provided on the platform, and the belt conveying part includes a flat belt and two flat belt pulleys configured to support and drive the flat belt. Each of the flat belt pulleys is mounted onto the platform via a pulley rotating shaft, and the pulley rotating shaft is equipped with a connecting gear configured to receive an external power.

Further, an elastic strip is further provided on the platform, and the elastic strip has two ends fixed onto the platform, and a middle portion forming an arched elastic platform part. The elastic platform part is higher than the flat belt by 1 mm to 2 mm in a free state, so as to prevent a first banknote from contacting with the flat belts when entering the platform, which may otherwise stop the moving of the banknote and cause untidy stacking of banknotes.

Further, two belt conveying parts and two elastic strips are provided on the platform, and the belt conveying parts and the elastic strips are symmetrical arranged in parallel with each other along a middle line of the platform in the banknote conveying direction.

Preferably, the banknote stacking device further includes an output mechanism configured to output a whole stack of banknotes stacked on the platform in stack. The output mechanism includes an upper output conveying belt and an upper output rotating shaft, and the upper output rotating shaft is controlled by a pressure spring to move up and down to self-adapt to the thickness of stacked banknotes.

Preferably, a protrusion is provided on each of edges, close to the front baffle and the rear baffle, of the platform, and ribs cooperating with the protrusions are formed on surfaces of the front baffle and the rear baffle at corresponding positions.

A banknote processing apparatus is further provided according to the present application, which includes a banknote inlet/outlet for depositing and withdrawing banknotes, a banknote conveying passage configured to convey banknotes, a banknote recycling box configured to recycle banknotes, and a banknote cassette configured to store banknotes, and the banknote processing apparatus is characterized in that the banknote processing apparatus further includes the banknote stacking device described above.

Compared with the conventional technology, the banknote stacking device according to the present application has the following advantages.

Due to employing the pressing and conveying mechanism, the banknote stacking device according to the present application has a simpler configuration and a lower cost than a normal manipulator-type clamping mechanism. While pressing the banknotes, the O-shaped belt conveys the banknotes forward to the position of the baffle, which can ensure the banknotes to be stacked tidily while preventing the banknotes from flying away.

DETAILED DESCRIPTION

For further elaborating a banknote stacking device according to the present application, the banknote stacking device is further described in detail hereinafter with reference to an illustration of a preferred embodiment of the present application.

Figure 1:
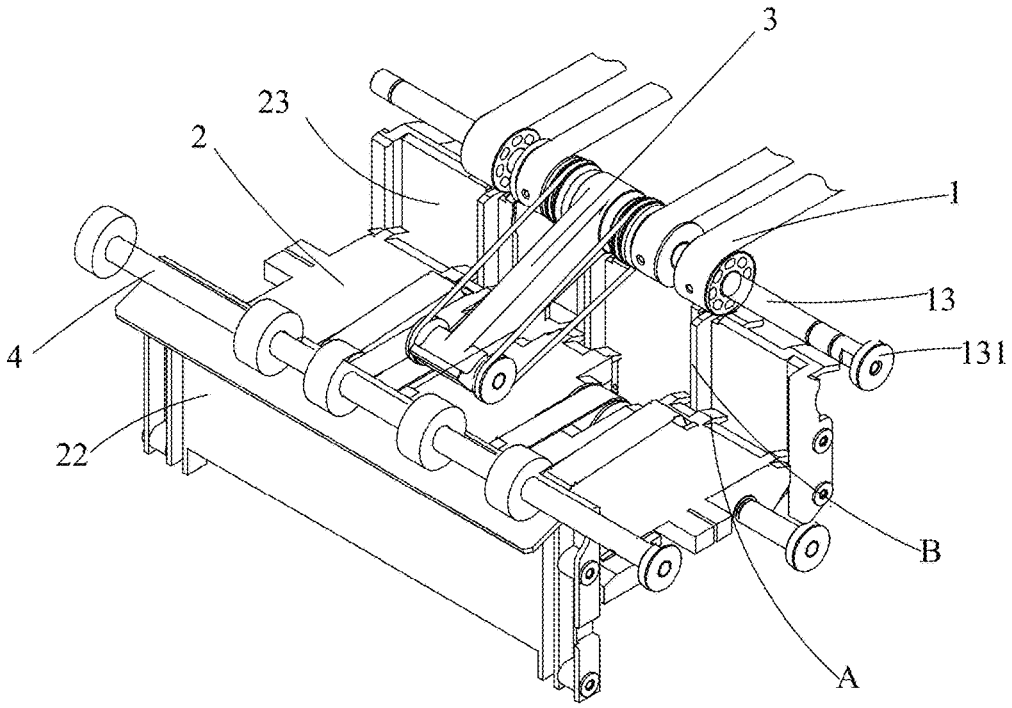
FIG. 1 is a schematic view showing the structure of a banknote stacking device according to the present application.
Figure 2:
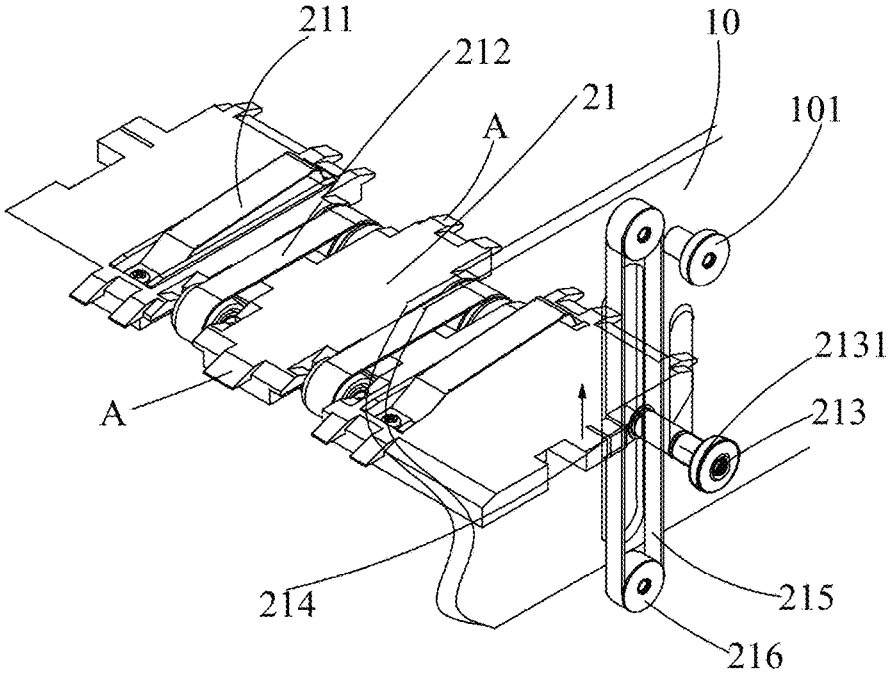
FIG. 2 is a schematic view of a stacking platform mechanism in FIG. 1 in a banknote stacking state.
Figure 3:
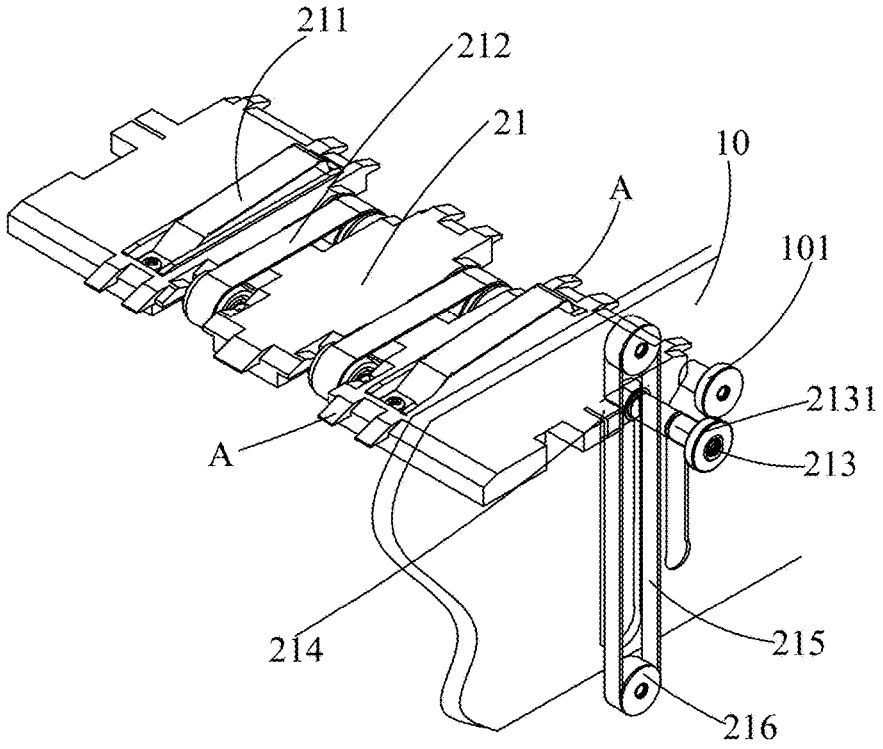
FIG. 3 is a schematic view of the stacking platform mechanism in a banknote outputting state.
Figure 4:
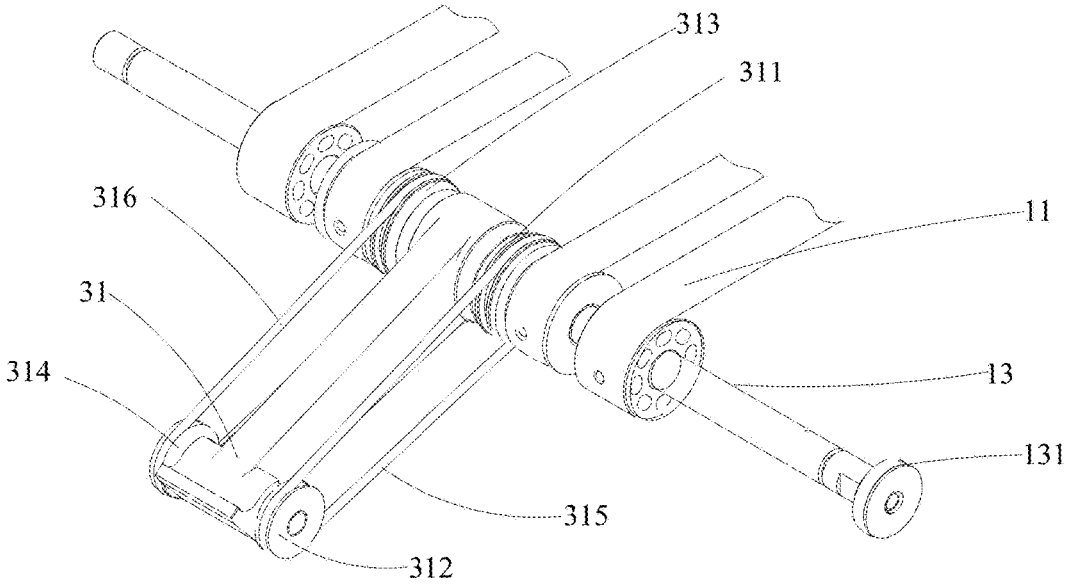
FIG. 4 is a schematic view showing the structure of a pressing and conveying mechanism in FIG. 1.
Figure 5:
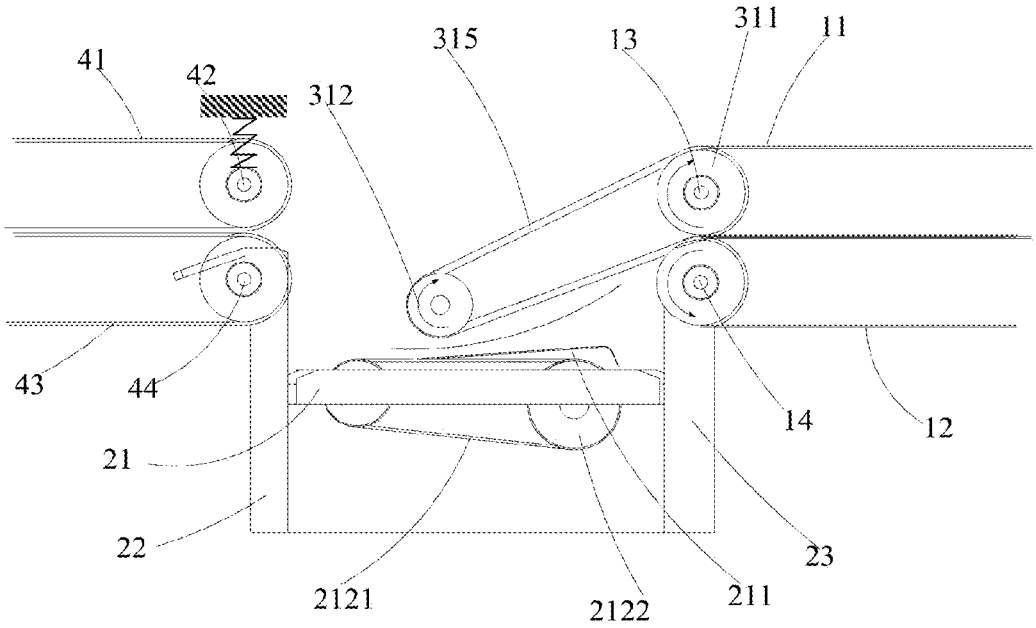
FIG. 5 is a schematic view showing that the banknotes just enter the banknote stacking device.

Reference is made to FIGS. 1 to 4 and FIG. 10, a structure of the banknote stacking device 06 according to the present application is described in detail. The banknote stacking device 06 includes: an input mechanism 1, a stacking platform mechanism 2, and a pressing and conveying mechanism 3. The input mechanism 1 is configured to convey the banknotes one by one and includes an upper conveying belt 11, a lower conveying belt 12, an upper conveying rotating shaft 13 configured to drive the upper conveying belt 11, and a lower conveying rotating shaft 14 configured to drive the lower conveying belt 12. The upper conveying rotating shaft 13 is driven by a transmission gear 131 to rotate, and the transmission gear 131 is arranged at one end of the upper conveying rotating shaft 13 and configured to receive an external power, as shown in FIG. 5. The stacking platform mechanism 2 is configured to stack and support banknotes conveyed into the stacking platform mechanism 2 one by one by the input mechanism 1. The stacking platform mechanism 2 includes a platform 21 configured to carry banknotes. The platform 21 and two baffles 22 and 23 arranged front and rear in a banknote conveying direction define a space for stacking and storing banknotes. The platform 21 may be selectively moved up and down by a lifting mechanism. Preferably, the lifting mechanism is a synchronous belt-pulley set driven by a step motor, as shown in FIG. 2. The pressing and conveying mechanism 3 is located above the stacking platform mechanism 2, and is configured to press banknotes tightly and convey the banknotes stacked on the platform 21 forward. The pressing and conveying mechanism 3 has a pressing rod 31, and the pressing rod 31 has one end rotatably arranged on the upper conveying rotating shaft 13 and another end forming a free end and freely falling on the platform 21. A first concave wheel 311 and a third concave wheel 313 are respectively arranged on two sides of the rotatably securing end of the pressing rod 31, and a second concave wheel 312 and a fourth concave wheel 314 are respectively arranged on two sides of the free end of the pressing rod 31. A first O-shaped belt 315 is arranged on the first concave wheel 311 and the second concave wheel 312 to form a first driving belt-wheel set. A second O-shaped belt 316 is arranged on the third concave wheel 313 and the fourth concave wheel 314 to form a second driving belt-wheel set. Specifically, the first concave wheel 311, the third concave wheel 313 rotate synchronously with the upper conveying rotating shaft 13, as shown in FIG. 4. The banknotes conveyed by the input mechanism 1 one by one are conveyed into the stacking platform mechanism 2. While the pressing and conveying mechanism 3 presses the banknotes onto the stacking platform mechanism 2, the concave wheels 311 and 312 and the O-shaped belts 315 and 316 thereon of the pressing and conveying mechanism 3 are driven synchronously forward, and the friction force between the O-shaped belts 315 and 316 and the banknotes drives the banknotes to move forward to a position of the front baffle 22, which allows front ends of the banknotes to be aligned with the front baffle 22.

Referring to FIG. 5, for outputting the whole stack of banknotes, the banknote stacking device further includes an output mechanism 4 configured to output the whole stack of banknotes stacked on the platform. The output mechanism 4 includes an upper output conveying belt 41, an upper output rotating shaft 42, a lower output conveying belt 43, and a lower output rotating shaft 44. The upper output rotating shaft 42 is controlled by a pressure spring to move up and down with respect to the lower output rotating shaft 44 so as to self-adapt to the thickness of the stacked banknotes.

Referring to FIGS. 2 to 3 and FIG. 5, the structure of the stacking platform mechanism 2 is further described in detail. The stacking platform mechanism 2 is constituted by the platform 21, two elastic strips 211, and belt conveying parts 212. The belt conveying parts 212 are respectively located at two sides of the platform 21. The belt conveying parts 212 are provided with two set of a flat belt 2121 and flat belt pulleys 2122, and the flat belt 2121 is mounted on two flat belt pulleys 2122. The flat belt pulleys 2122 are mounted onto the platform 21 via a pulley rotating shaft 213, and the pulley rotating shaft 213 is equipped with a power connecting gear 2131. The elastic strips 211 are respectively mounted at two sides of the belt conveying parts 212 on the platform 21, and are arranged symmetrically in parallel with each other along a middle line of the platform 21 in the banknote conveying direction. A protrusion A is provided at each of a front end and a rear end of the platform 21. These protrusions are crossed and overlapped with protruding ribs B on the front baffle 22 and the rear baffle 23, so as to prevent banknotes in a banknote staking region from entering a gap between the platform 21 and the front baffle 22 and a gap between the platform 21 and the rear baffle 23. Further, the two elastic strips 211 arranged on the platform 21 are higher than the flat belts 2121 on the platform 21 by 1 mm to 2 mm in an initial state, so as to prevent a first banknote from contacting with the flat belts 2121 when entering the platform 21, which may otherwise stop the moving of the banknote and cause untidily stacking of the banknotes.

The lifting mechanism configured to control the platform 21 to move up and down is further described. The lifting mechanism is constituted by a synchronous belt 215 and a belt pulley 216 which are driven by a step motor, and the platform 21 is provided with a holding device 214 for the synchronous belt 215. The working principle of the stacking platform mechanism 2 in the process of banknote stacking and the process of banknote outputting after the banknote stacking is further described. Reference is made to FIGS. 2 and 5, which are schematic views of the stacking platform mechanism in a banknote stacking state. The platform 21 is driven by a synchronous belt 215 to descend to a predetermined position. The power connecting gear 2131 and an external power gear 101 are in a disengaging state, at this time, the two flat belts 2121 are in a rest state due to losing power, which facilitates the stacking of banknotes. With the increase of the banknotes stacked, the synchronous belt 215 drives the platform to gradually descend, so as to ensure a stacking space for banknotes conveyed in the stacking platform mechanism 2 to be maintained in a predetermined range.

Figure 7:
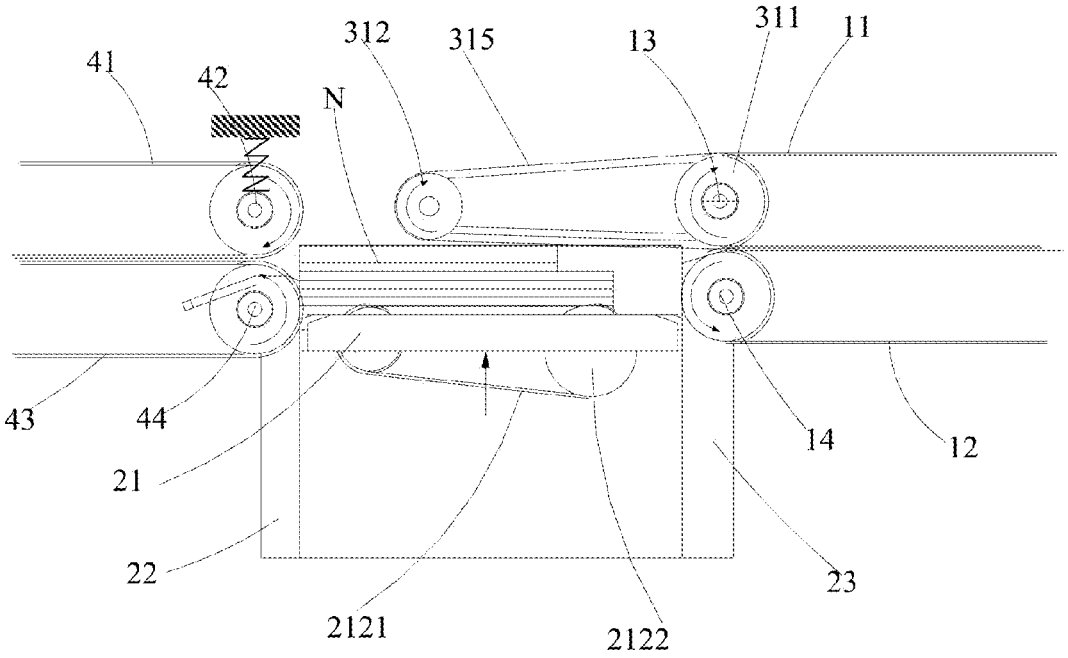
FIG. 7 is a first state view in which the banknotes stacked by the banknote stacking device are being outputted.

Referring to FIGS. 3 and 7, when the banknotes are stacked on the platform 21 and are prepared to be outputted outwards, the synchronous belt 215 is driven by an external step motor to rotate, and the synchronous belt 215 drives the platform 21 to lift by being connected to the holding device 214 of the platform 21. When the platform 21 is lifted to a predetermined position (the position is controlled by a sensor), the connecting gear 2131 of the pulley rotating shaft 213 is engaged with the external power gear 101 of a mounting frame 10, to drive the two flat belts 2121 to rotate, thus bringing the banknotes stacked on the flat belts 2121 to be outputted smoothly.

Referring to FIG. 4, the pressing and conveying mechanism 3 is described in detail. The pressing and conveying mechanism 3 is located above the stacking platform mechanism 2, and is configured to press the banknotes and convey the banknotes stacked on the platform 21 forward. The pressing and conveying mechanism 3 has a pressing rod 31, and the pressing rod 31 has one end rotatably arranged on the upper conveying rotating shaft 13 and another end forming a free end and freely falling towards the platform 21. A first concave wheel 311 and a third concave wheel 313 are respectively arranged on two sides of the rotatable securing end of the pressing rod 31, and a second concave wheel 312 and a fourth concave wheel 314 are respectively arranged on two sides of the free end of the pressing rod 31. A first O-shaped belt 315 is arranged on the first concave wheel 311 and the second concave wheel 312 to form a first driving belt-wheel set. A second O-shaped belt 316 is arranged on the third concave wheel 313 and the fourth concave wheel 314 to form a second driving belt-wheel set. Specifically, the first concave wheel 311 and the third concave wheel 313 rotate synchronously with the upper conveying rotating shaft 13. The banknotes conveyed by the input mechanism 1 one by one are conveyed into the stacking platform mechanism 2. While the pressing and conveying mechanism 3 presses the banknotes onto the stacking platform mechanism 2, the concave wheels 311 and 312 and the O-shaped belts 315 and 316 thereon of the pressing and conveying mechanism 3 are driven synchronously forward, and the friction force between the O-shaped belts 315 and 316 and the banknotes drives the banknotes to move forward to a position of the front baffle 22, which allows front ends of the banknotes to be aligned with the front baffle 22.

Referring to FIGS. 5 to 9, a working process of the banknote stacking device performing banknote stacking is further described, as shown in FIG. 5, which is a schematic view showing that the banknotes just enter the banknote stacking device. The first concave wheel 311 and the third concave wheel 313 on the pressing and conveying mechanism 3 are driven by the upper conveying rotating shaft 13 to rotate, and the O-shaped belts 315 and 316, the second concave wheel 312 and the fourth concave wheel 314 are driven to rotate simultaneously. The conveyed banknotes N are guided into the stacking region by the pressing and conveying mechanism 3. In this process, the O-shaped belts 315 and 316 provide a forward force and push the banknotes N till the banknotes N contact with the front baffle 22. Since the force provided by the O-shaped belts 315, 316 to the banknotes N is smaller than the resistance received by surrounding areas of the banknotes N, the O-shaped belts 315 and 316 begin to slip on the banknotes, and the banknotes N stop moving. The banknotes N conveyed by the input mechanism 1 are stacked on the stacking platform mechanism 2 one by one. Due to the action of forward conveying by the pressing and conveying mechanism 3, front ends of the banknotes N abut against the front baffle 22, which makes the front ends of the banknotes tidy. The pressing and conveying mechanism 3 presses the banknotes N by self-gravity. The lower elastic strips 211 both further press the banknotes N upwards and at the same time prevent the banknotes N from being deformed and bent.

Figure 6:
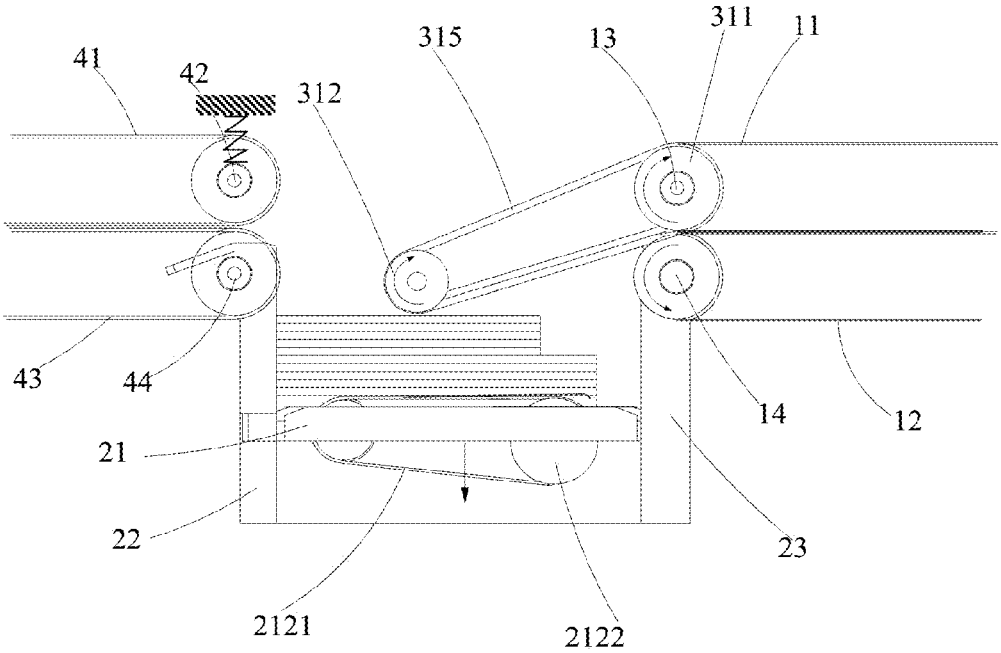
FIG. 6 is a schematic view of a process of stacking of the banknote stacking device.

In addition, as a certain number of banknotes enter the stacking platform mechanism 2, the stacking platform mechanism 2 is driven by the external motor to descend by a certain distance (for example, if the thickness of one banknote is counted as 0.1 mm, the platform descend by 2 mm when every twenty banknotes enter, which can be set according to a specific structure), as shown in FIG. 6.

Figure 8:
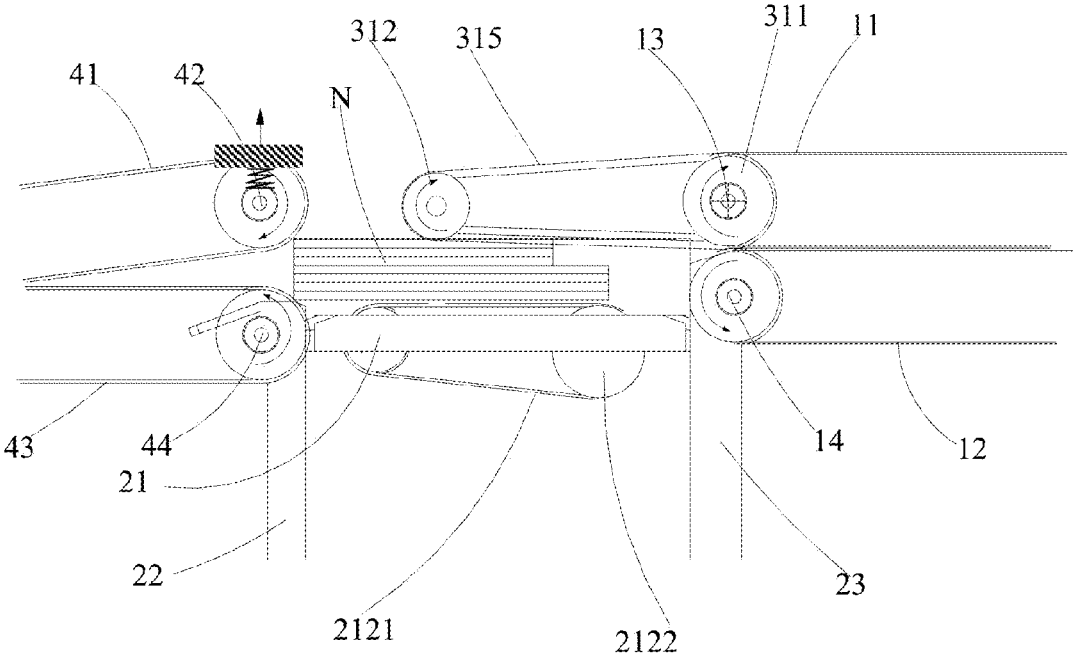
FIG. 8 is a second state view in which the banknotes stacked by the banknote stacking device are being outputted.
Figure 9:
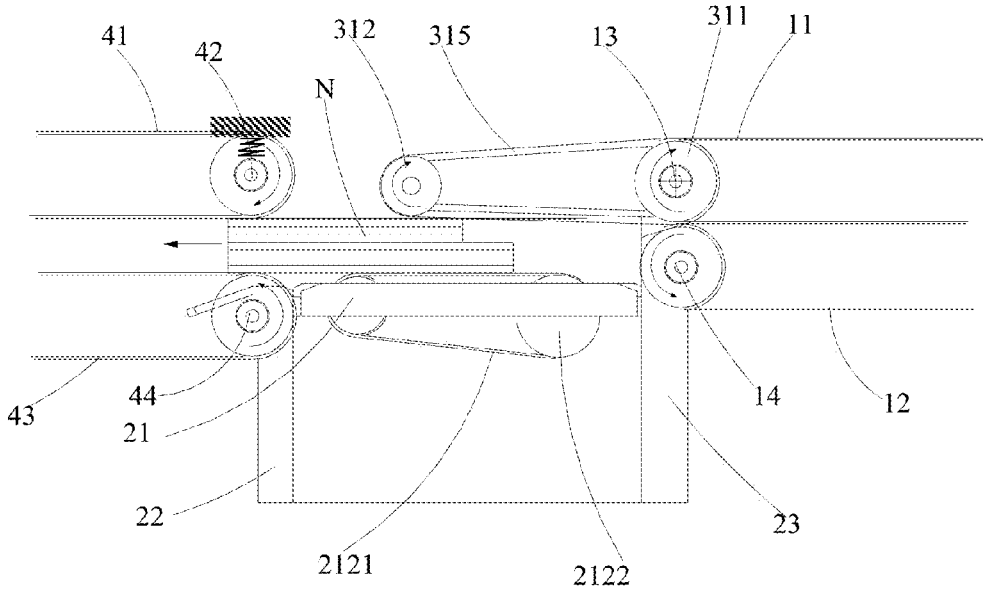
FIG. 9 is a third state view in which the banknotes stacked by the banknote stacking device are being outputted.

Referring to FIGS. 2 and 3 and FIGS. 7 to 9, the process of outputting the banknotes stacked by the banknote stacking device is described. When the banknotes processed in one time are stacked tidily, the platform 21 of the stacking platform mechanism 2 is driven by the synchronous belt 215 to be lifted to a certain position (which is controlled by a sensor), and the banknotes are pressed between the pressing and conveying mechanism 3 and the platform 21, as shown in FIG. 7. At the same time, the power connecting gear 2131, configured to drive the flat belt pulleys 2122 and the belt pulley rotating shaft 213 to rotate, on the platform 21 is engaged with the external power gear 101, as shown in FIG. 3. Since the upper conveying belt 11, the O-shaped belt 315 are rotated in a direction indicated by arrows in the drawing, and clamp the banknotes in a whole stack to move forward, and since the upper output rotating shaft 42 is movable up and down controlled by the pressure spring, as shown in FIG. 8, the whole stack of banknotes push the upper output conveying belt 41 and the upper output rotating shaft 42 to move upward, and enter the output mechanism 4 to be outputted in a whole stack, as shown in FIG. 9.

Figure 10:
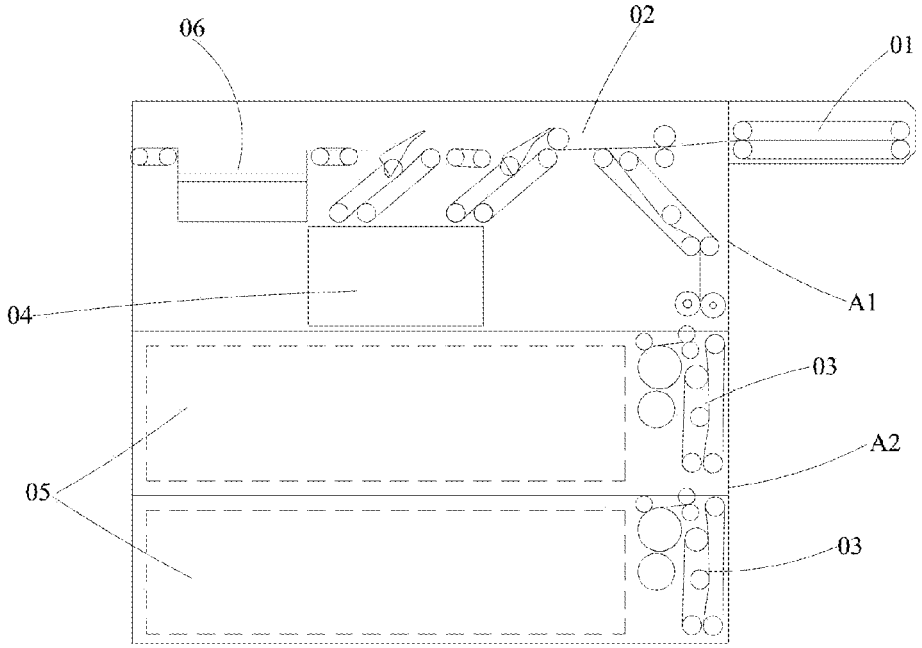
FIG. 10 is a schematic view showing the structure of a banknote processing device according to the present application.

A banknote processing device is further provided according to an embodiment of the present application, as shown in FIG. 10. The banknote processing device may be generally divided into an upper module A1 and a lower module A2. The upper module A1 mainly consists of a banknote inlet/outlet 01, a banknote conveying passage 02, a banknote recycling box 04, and the banknote stacking device 06 according to the present application, etc. The lower module A2 mainly consists of a lower conveying passage 03, a banknote cassette 05, etc.

The person skilled in the art may clearly know that, for convenience and concise of the description, the specific working process of the system, device, and unit described above may refer to the corresponding process in the embodiment of the method described above, which will not be described herein again.

The above description is only preferred embodiments of the present application. It should be noted that, the above preferred embodiments should not be deemed as a limitation to the present application, and the scope of the present application is defined by the claims of the present application. For the person skilled in the art, several improvements and modifications may be made to the present application without departing from the spirit and scope of the present application, and these improvements and modifications are also deemed to fall into the scope of the present application.

The invention claimed is:

1. A banknote stacking device, comprising:

an input mechanism configured to convey banknotes one by one, which comprises an upper conveying belt and an upper conveying rotating shaft configured to drive the upper conveying belt;

a stacking platform mechanism configured to stack and support banknotes conveyed by the input mechanism one by one, which comprises a platform configured to carry banknotes, wherein the platform and two baffles arranged front and rear in a banknote conveying direction define a space for stacking and storing banknotes, and the platform is controlled by a lifting mechanism to selectively move up and down; and a pressing and conveying mechanism located above the stacking platform mechanism and configured to press banknotes and convey the banknotes stacked on the platform forward, wherein the pressing and conveying mechanism has a pressing rod, and the pressing rod has one end rotatably arranged on the upper conveying rotating shaft and another end forming a free end and falling freely towards the platform, the rotatable securing end and the free end of the pressing rod are respectively provided with a first concave wheel and a second concave wheel, and a first O-shaped belt is arranged on the first concave wheel and the second concave wheel, wherein the first concave wheel rotates synchronously with the upper conveying rotating shaft.

2. The banknote stacking device according to claim 1, wherein the first concave wheel and a third concave wheel are respectively arranged on two sides of the rotatable securing end of the pressing rod, and the second concave wheel and a fourth concave wheel are respectively arranged on two sides of the free end of the pressing rod, wherein the first O-shaped belt is arranged on the first concave wheel and the second concave wheel, and a second O-shaped belt is arranged on the third concave wheel and the fourth concave wheel, wherein the first concave wheel and the third concave wheel rotate synchronously with the upper conveying rotating shaft.

3. The banknote stacking device according to claim 1, wherein a belt conveying part is provided on the platform, and the belt conveying part comprises a flat belt and two flat belt pulleys configured to support and drive the flat belt, each of the flat belt pulleys is mounted onto the platform via a pulley rotating shaft, and the pulley rotating shaft is equipped with a connecting gear configured to receive external power.

4. The banknote stacking device according to claim 3, wherein an elastic strip is further provided on the platform, the elastic strip has two ends fixed onto the platform and a middle portion forming an arched elastic platform part, wherein the elastic platform part is higher than the flat belt by 1 mm to 2 mm in a free state.

5. The banknote stacking device according to claim 4, wherein two belt conveying parts and two elastic strips are provided on the platform, wherein the belt conveying parts and the elastic strips are symmetrical arranged in parallel with each other along a middle line of the platform in the banknote conveying direction.

6. The banknote stacking device according to claim 1, further comprising an output mechanism configured to output a whole stack of banknotes stacked on the platform, wherein the output mechanism comprises an upper output conveying belt and an upper output rotating shaft, wherein the upper output rotating shaft is controlled by a pressure spring to move up and down to self-adapt to the thickness of stacked banknotes.

7. The banknote stacking device according to claim 1, wherein a protrusion is provided on each of edges, close to the front baffle and the rear baffle, of the platform, and ribs cooperating with the protrusions are formed on surfaces of the front baffle and the rear baffle at corresponding positions.

8. A banknote processing apparatus, comprising a banknote inlet/outlet for depositing and withdrawing banknotes, a banknote conveying passage configured to convey banknotes, a banknote recycling box configured to recycle banknotes, and a banknote cassette configured to store banknotes, and further comprising the banknote stacking device according to claim 1.

9. A banknote processing apparatus, comprising a banknote inlet/outlet for depositing and withdrawing banknotes, a banknote conveying passage configured to convey banknotes, a banknote recycling box configured to recycle banknotes, and a banknote cassette configured to store banknotes, and further comprising the banknote stacking device according to claim 2.

10. A banknote processing apparatus, comprising a banknote inlet/outlet for depositing and withdrawing banknotes, a banknote conveying passage configured to convey banknotes, a banknote recycling box configured to recycle banknotes, and a banknote cassette configured to store banknotes, and further comprising the banknote stacking device according to claim 3.

11. A banknote processing apparatus, comprising a banknote inlet/outlet for depositing and withdrawing banknotes, a banknote conveying passage configured to convey banknotes, a banknote recycling box configured to recycle banknotes, and a banknote cassette configured to store banknotes, and further comprising the banknote stacking device according to claim 4.

12. A banknote processing apparatus, comprising a banknote inlet/outlet for depositing and withdrawing banknotes, a banknote conveying passage configured to convey banknotes, a banknote recycling box configured to recycle banknotes, and a banknote cassette configured to store banknotes, and further comprising the banknote stacking device according to claim 5.

13. A banknote processing apparatus, comprising a banknote inlet/outlet for depositing and withdrawing banknotes, a banknote conveying passage configured to convey banknotes, a banknote recycling box configured to recycle banknotes, and a banknote cassette configured to store banknotes, and further comprising the banknote stacking device according to claim 6.

* * * * *